US010319518B2

(12) United States Patent
Qi et al.

(10) Patent No.: US 10,319,518 B2
(45) Date of Patent: Jun. 11, 2019

(54) METHOD OF MANUFACTURING A VERTICAL INDUCTOR

(71) Applicant: SEMICONDUCTOR MANUFACTURING INTERNATIONAL (SHANGHAI) CORPORATION, Shanghai (CN)

(72) Inventors: Dekui Qi, Shanghai (CN); Haifang Zhang, Shanghai (CN); Xuanjie Liu, Shanghai (CN); Zheng Chen, Shanghai (CN); Xin Li, Shanghai (CN)

(73) Assignee: SEMICONDUCTOR MANUFACTURING INTERNATIONAL (SHANGHAI) CORPORATION, Shanghai (CN)

( * ) Notice: Subject to any disclaimer, the term of this patent is extended or adjusted under 35 U.S.C. 154(b) by 0 days.

(21) Appl. No.: 15/963,033

(22) Filed: Apr. 25, 2018

(65) Prior Publication Data

US 2018/0247762 A1 Aug. 30, 2018

Related U.S. Application Data

(62) Division of application No. 14/687,839, filed on Apr. 15, 2015, now Pat. No. 9,984,819.

(30) Foreign Application Priority Data

Apr. 22, 2014 (CN) ..... 2014 1 0163827

(51) Int. Cl.

| | |
|---|---|
| ***H01F 5/00*** | (2006.01) |
| ***H01F 41/04*** | (2006.01) |
| ***H01F 17/00*** | (2006.01) |

(52) U.S. Cl.

CPC ..... *H01F 41/041* (2013.01); *H01F 5/00* (2013.01); *H01F 17/0013* (2013.01); *H01F 2017/002* (2013.01)

(58) Field of Classification Search

CPC ..... H01F 5/00; H01F 27/00–36

(Continued)

(56) References Cited

U.S. PATENT DOCUMENTS 6,989,578 B2 1/2006 Yeh et al.
8,072,042 B1 * 12/2011 Kroener ..... H01F 41/046 257/531

(Continued)

FOREIGN PATENT DOCUMENTS

| | | |
|---|---|---|
| CN | 105084291 | 11/2015 |
| CN | 105084291 | 9/2017 |
| GB | 2509296 | 7/2017 |

OTHER PUBLICATIONS

U.S. Appl. No. 14/687,839, Final Office Action dated Oct. 5, 2017, 8 pages.

(Continued)

*Primary Examiner* — Tuyen T Nguyen
(74) *Attorney, Agent, or Firm* — Kilpatrick Townsend & Stockton LLP

(57) ABSTRACT

A method of fabricating a spiral inductor includes providing a substrate having a top surface and a bottom surface, forming a plurality of through holes aligned in a vertical plane and spaced apart from each other, forming a metal interconnect structure having at least one top metal layer on the top surface of the substrate, the metal interconnect structure configured to connect to a top portion of the through holes, and forming a redistribution layer having at least a bottom layer on the bottom surface of the substrate. The redistribution layer is configured to connect to a bottom portion of the through holes to form a spiral structure.

20 Claims, 5 Drawing Sheets

(58) Field of Classification Search
USPC ..... 336/65, 83, 200, 232; 29/602.1
See application file for complete search history.

(56) References Cited

U.S. PATENT DOCUMENTS

| | | | | |
|---|---|---|---|---|
| 8,072,307 | B2 | 12/2011 | Kijima | |
| 9,111,933 | B2 * | 8/2015 | Carpenter | H01L 23/49827 |
| 9,921,640 | B2 * | 3/2018 | Zillmann | G06F 1/3296 |
| 2006/0022787 | A1 | 2/2006 | Brennan et al. | |
| 2008/0213966 | A1 | 9/2008 | Lee et al. | |
| 2010/0078771 | A1 | 4/2010 | Barth et al. | |
| 2011/0073987 | A1 | 3/2011 | Mackh et al. | |
| 2013/0027127 | A1 | 1/2013 | Topaloglu | |
| 2015/0302975 | A1 | 10/2015 | Qi et al. | |

OTHER PUBLICATIONS

U.S. Appl. No. 14/687,839, Non-Final Office Action dated Mar. 9, 2017, 7 pages.
U.S. Appl. No. 14/687,839, Notice of Allowance dated Jan. 25, 2018, 5 pages.
U.S. Appl. No. 14/687,839, Restriction Requirement dated Nov. 3, 2016, 6 pages.

* cited by examiner

METHOD OF MANUFACTURING A VERTICAL INDUCTOR

CROSS-REFERENCES TO RELATED APPLICATIONS

This application is a divisional of U.S. application Ser. No. 14/687,839, filed on Apr. 15, 2015, which claims priority to Chinese patent application No. 201410163827.4, filed on Apr. 22, 2014, the contents of which are incorporated herein by reference in their entirety.

BACKGROUND OF THE INVENTION

The present invention relates to semiconductor technology, and more particularly to a vertical inductor and method of manufacturing the same.

Due to the continuous demand of increased memory capacity in semiconductor devices, a number of process techniques has been employed to reduce the memory cell structure for increasing the integration density.

As portable electronic devices become more compact, and the number of functions performed by a given device increases, the manufacturing process has become more complex as more functions must be integrated into the given device. Accordingly, 3D integrated circuit technology is being employed more extensively.

Micro-electromechanical systems (MEMS) have the advantages of size, power consumption, weight, reliability and costs. MEMS have been used in a variety of sensors, such as pressure sensors, acceleration sensors, inertial sensors, and other sensors.

In general, integrated passive devices and micro-electromechanical systems (MEMS) contain one or more spiral inductors, which occupy a large silicon area of the integrated circuit. Due to the electric characteristics of inductors, their size cannot be reduced in the same way as feature sizes of devices in the CMOS technology.

FIG. 1A shows a structure of a spiral inductor, which includes a stack of one or more metal layers wound in a polygonal (square) shape in the longitudinal (horizontal) direction. FIG. 1B shows another structure of a spiral inductor, which is formed with two metal layers connected by multiple vias. The structures of FIGS. 1A and 1B are planar and occupy a relative large silicon area.

Furthermore, magnetic fields generated by active areas, polysilicon and metal layers may have an impact on the performance of the spiral inductor so that active areas, polysilicon and metal layers, and dummy patterns are not allowed to be present below the spiral inductor.

Thus, there is a need for a novel spiral inductor structure and a method of manufacturing the same to eliminate the drawbacks of the conventional planar spiral inductors.

BRIEF SUMMARY OF THE INVENTION

Embodiments of the present invention relate to semiconductor technology, and more particularly to a vertical spiral inductor and method of manufacturing the same.

According to one embodiment of the present invention, a spiral inductor is formed in a vertical plane relative to a planar surface of a substrate. The spiral inductor includes a substrate having a top surface and a bottom surface, multiple through holes disposed in the vertical plane and spaced apart from each other, a metal interconnect structure on the top surface, and a redistribution layer on the bottom surface. The metal interconnect structure and the redistribution layer are connected to each other through the through holes to form the spiral inductor.

In one embodiment, the metal interconnect structure includes top vias.

In one embodiment, the redistribution layer includes bottom vias.

In one embodiment, the spiral inductor further includes a first terminal and a second terminal disposed on the top surface of the substrate and located at opposite ends of the spiral inductor.

In one embodiment, the through holes include a first through hole, a second through hole, a third through hole, and a fourth through hole. The second through hole is connected to the third through hole through a first bottom metal layer of the redistribution layer. The first through hole is connected to the third through hole through a first top metal layer of the metal interconnect layer, and the first through hole is connected to the fourth through hole through a second bottom metal layer of the redistribution layer.

In one embodiment, the first through hole and the third through hole are connected to each other through the first top metal layer, a top via and a second top metal layer of the metal interconnect layer. The first through hole and the fourth through hole are connected to each other through the first bottom metal layer, a bottom via and the second bottom metal layer.

In one embodiment, a spacing between the first and second through holes is equal to a spacing between the third and fourth through holes, and a spacing between the second and third through holes is larger than the spacing between the first and second through holes.

In one embodiment, the spiral inductor further includes a top dielectric layer, in which the metal interconnected layer is embedded, and a bottom dielectric layer, in which the redistribution layer is embedded.

In one embodiment, the substrate is made of silicon or glass.

In one embodiment, each of the through holes includes a liner layer on an inner surface, a barrier layer on the liner layer, and a conductive layer on the barrier layer.

Embodiments of the present invention also provide a method of fabricating a spiral inductor. The method includes providing a substrate having a top surface and a bottom surface, and forming multiple through holes that are aligned in a vertical plane and spaced apart from each other. The method also includes forming a metal interconnect structure having at least one top metal layer on the top surface of the substrate, the metal interconnect structure being configured to connect to a top portion of the through holes, and forming a redistribution layer having at least a bottom layer on the bottom surface of the substrate. The redistribution layer is configured to connect to a bottom portion of the through holes to form a spiral structure.

In one embodiment, the method further includes, after forming the metal interconnect structure, forming a protective layer on the metal interconnect structure. The method also includes removing the protective layer after forming the redistribution layer.

In one embodiment, the method also includes forming multiple bottom vias in the redistribution layer.

In one embodiment, the through holes include a first through hole, a second through hole, a third through hole, and a fourth through hole. The method further includes forming a first top metal layer having a plurality of spaced apart portions, forming a plurality of top vias on the first top metal layer, and forming a second top metal layer on the plurality of top vias. In one embodiment, the second top metal layer has at least three portions: a first portion connects the first through hole with the third through hole through first and second top vias, a second portion connects with the second through hole through a third top via to form a first connecting terminal, and a third portion connects with the fourth through hole through a fourth top via to form a second connecting terminal.

In one embodiment, the through holes include a first through hole, a second through hole, a third through hole, and a fourth through hole. The method further includes removing a portion of the bottom surface of the substrate to expose the bottom portion of the through holes, forming a first bottom metal layer having a plurality of spaced apart portions, wherein one of the spaced apart portions connects with the second and third through holes. The method also includes forming a plurality of bottom vias on the first bottom metal layer, and forming a second bottom metal layer on the bottom vias connecting the first and fourth through holes.

Embodiments of the present invention also provide an electronic device containing a spiral inductor disposed in a vertical plane relative to a planar surface of a substrate. The spiral inductor includes a plurality of through holes disposed in the vertical plane and spaced apart from each other, a metal interconnect structure on the top surface and having at least one top metal layer, and a redistribution layer on the bottom surface and having at least one bottom metal layer. The metal interconnect structure and the redistribution layer are connected to each other through the through holes to form the spiral inductor device.

The present invention provide a vertical spiral inductor that has better performance characteristics than those of conventional spiral inductors that are formed in a horizontal plane relative to the substrate. The vertical spiral inductor of the present invention requires a surface area that is significantly smaller due to the vertical structure with respect to the horizontal plane of the substrate. The vertical inductor according to the present invention has basically, in a top view, a rectangular shape having the width equal to the width of the interconnecting wire and the length equal to the spacing between two most spaced apart through holes.

The following description, together with the accompanying drawings, will provide a better understanding of the nature and advantages of the claimed invention.

BRIEF DESCRIPTION OF THE DRAWINGS

The accompanying drawings, which are incorporated in and constitute a part of the specification, illustrate embodiments of the present invention. The like reference labels in various drawings refer to the like elements.

DETAILED DESCRIPTION OF THE INVENTION

Figure 1A:
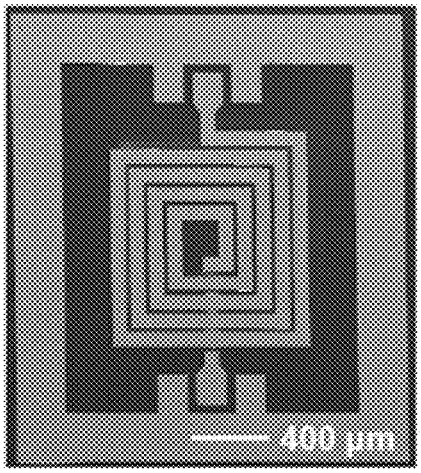
FIG. 1A (Prior Art)
FIG. 1A is a top plan view of a SEM image of an inductor of the prior art.
Figure 1B:
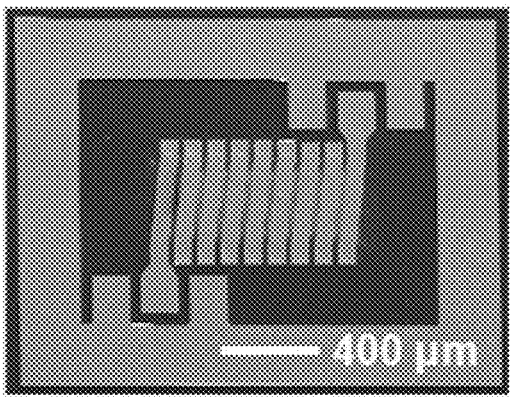
FIG. 1B (Prior Art)
FIG. 1B is a top plan view of a SEM image of another inductor of the prior art.

The present invention will be understood more fully from the detailed description given below and from the accompanying drawings of the preferred embodiments of the invention, which, however, should not be taken to limit the invention to the specific embodiments, but are for explanation and understanding only.

It should be understood that the drawings are not drawn to scale, and similar reference numbers are used for representing similar elements. Embodiments of the invention are described herein with reference to cross-section illustrations that are schematic illustrations of idealized embodiments (and intermediate structures) of the invention. The thickness of layers and regions in the drawings may be exaggerated relative to each other for clarity. Additionally, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

It will be understood that, when an element or layer is referred to as "on," "disposed on," "adjacent to," "connected to," or "coupled to" another element or layer, it can be disposed directly on the other element or layer, adjacent to, connected or coupled to the other element or layer, or intervening elements or layers may also be present. In contrast, when an element is referred to as being "directly on," directly disposed on," "directly connected to," or "directly coupled to" another element or layer, there are no intervening elements or layers present between them. It will be understood that, although the terms "first," "second," "third," etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Relative terms such as "under," "below," "underneath," "over," "on," "above," "bottom," and "top" are used herein to described a relationship of one element, layer or region to another element, layer or region as illustrated in the figures. It will be understood that these terms are intended to encompass different orientations of the structure in addition to the orientation depicted in the figures. For example, if the device shown in the figures is flipped, the description of an element being "below" or "underneath" another element would then be oriented as "above" the other element. Therefore, the term "below," "under," or "underneath" can encompass both orientations of the device. Because devices or components of embodiments of the present invention can be positioned in a number of different orientations (e.g., rotated 90 degrees or at other orientations), the relative terms should be interpreted accordingly.

The terms "substrate" and "wafer" may be used alternatively and may include silicon-on-insulator (SOI) or silicon-on-sapphire (SOS) technology, doped and undoped semiconductors, epitaxial layers of silicon supported by a base semiconductor foundation, and other semiconductor structures.

The use of the terms first, second, etc. do not denote any order, but rather the terms first, second, etc. are used to distinguish one element from another. Furthermore, the use of the terms a, an, etc. does not denote a limitation of quantity, but rather denote the presence of at least one of the referenced items. It will be further understood that the terms "comprising", "including", having" and variants thereof, when used in this specification, specify the presence of stated features, steps, operations, elements, and/or components, but do not preclude the presence or addition of one or more other features, steps, operations, elements, components, and/or groups thereof. Furthermore, as used herein, the words "and/or" may refer to and encompass any possible combinations of one or more of the associated listed items.

The term "vertical" as used in this application is defined as a plane perpendicular to the conventional plane or surface of a wafer or substrate, regardless of the orientation of the wafer or substrate. The term "horizontal" refers to a direction perpendicular to the vertical as defined above.

Exemplary Embodiment 1

Figure 2A:
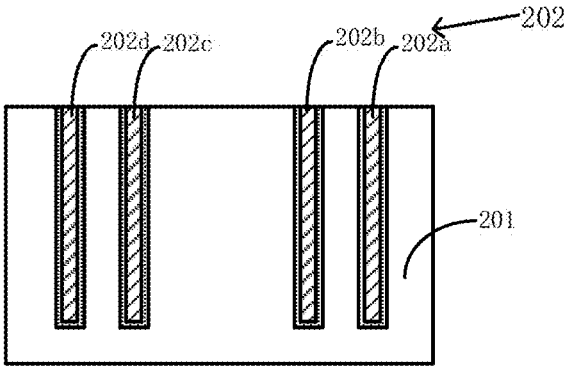
FIGS. 2A-2E are cross-sectional views of different stages in the manufacturing process of a spiral inductor according to an embodiment of the present invention.
Figure 2B:
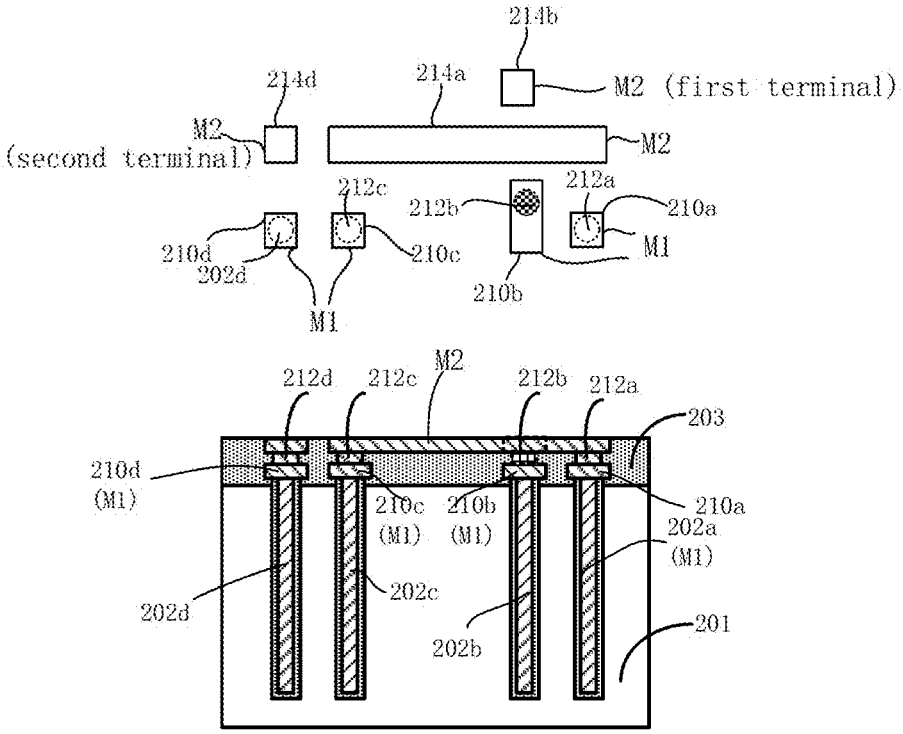
Figure 2C:
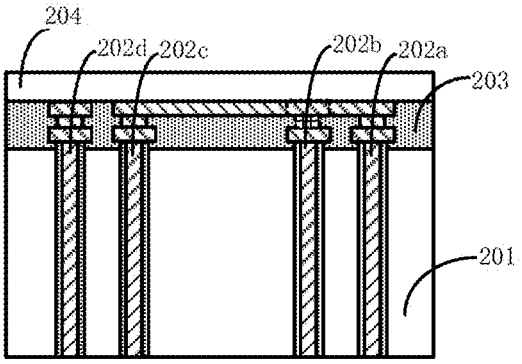
Figure 2D:
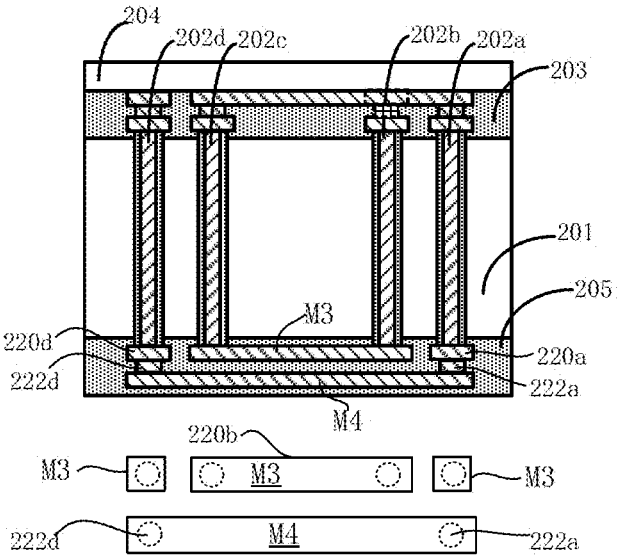
Figure 2E:
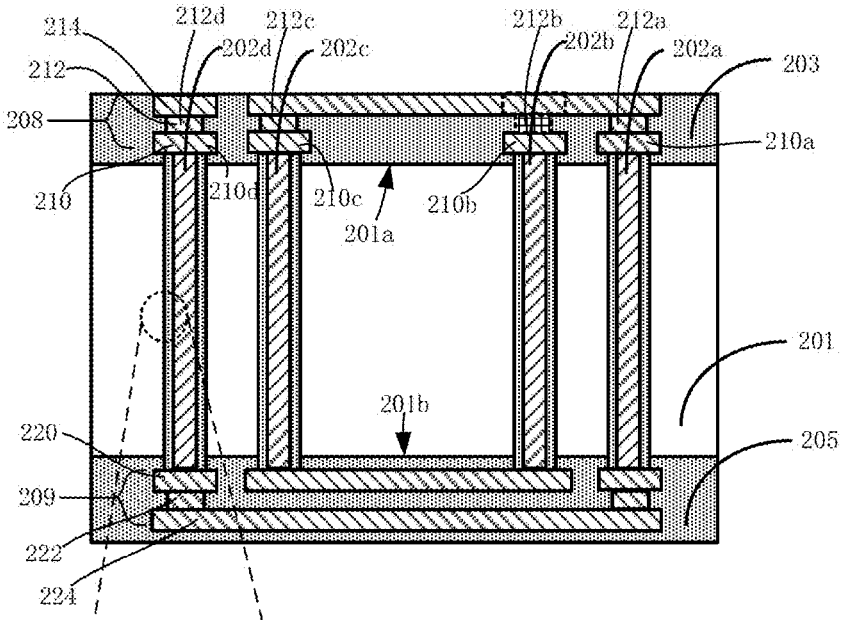

FIG. 2E is a cross-sectional view of a vertical spiral inductor according to an embodiment of the present invention. The cross-sectional view reflects the vertical design of the spiral inductor that is formed perpendicular to the plane of the substrate.

In the embodiment, the vertical spiral inductor includes a substrate (wafer) 201 having a top (front) surface 201*a* and a bottom (back) surface 201*b*, a number of through-holes (also referred to as through-silicon vias or TSVs) 202*a*, 202*b*, 202*c*, 202*d* (collectively referred to as through holes 202) disposed in the same vertical plane and physically separated from each other, a metal interconnect structure 208 disposed on the top (front) surface of the substrate and comprising at least a top metal layer, and a redistribution layer 209 disposed on the bottom (back) surface of the substrate and comprising at least a bottom metal layer. The through-holes 202, the metal interconnect structure 208 and the redistribution layer 209 are connected to each other to form a vertical spiral inductor.

In an embodiment, various CMOS devices may be formed in substrate 201, the CMOS devices may include active and/or passive devices, which can be manufactured using conventional semiconductor manufacturing processes.

The through holes (through-silicon vias) 202 go through the top and bottom surfaces of substrate 201 to connect the metal interconnect structure to the redistribution layer.

Figure 2F:
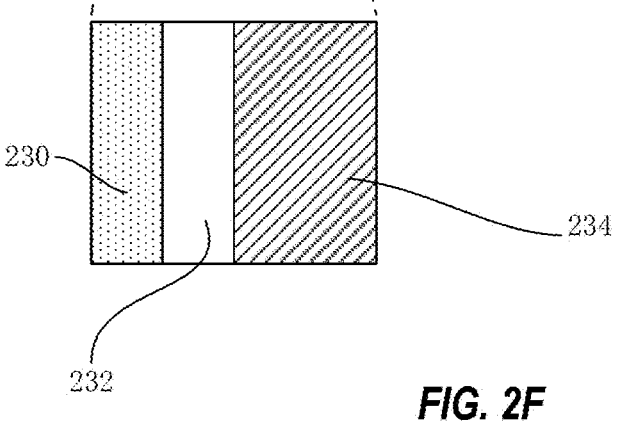
FIG. 2F is an enlarged cross-sectional view of a portion of FIG. 2E.

The through holes 202 include from the center to the inner surface a conductive layer 234 and a barrier layer 232 surrounding the conductive layer. In a specific embodiment, a liner layer 230 is further formed between the barrier layer 232 and the inner surface of the through holes 202. FIG. 2F is an enlarged cross-sectional view of a portion of one through hole 202. As shown, the liner layer 230 is disposed on the inner surface of the through hole, the barrier layer 232 is disposed on the liner layer 230 and the conductive layer 234 is disposed on the barrier layer 232 and filling the through hole 202.

The through holes are formed in the substrate and include a conductive layer disposed in their center, a barrier layer surrounding the conductive layer and a liner layer between the barrier layer and the inner surface of the through holes. In an embodiment, the conductive layer may be formed of a metal material comprising one of Pt, Au, Ti, and W, or a combination thereof. In another embodiment, the conductive layer may be polysilicon. In general, any conductive material can be used to form the conductive layer. In a preferred embodiment, the conductive layer is of Cu that can be formed using existing through-silicon vias process techniques.

The barrier layer is used to improve adhesion of a filled metal in the through hole and has a thickness in the range from 300 angstroms to 500 angstroms. The barrier layer may include one or more of titanium nitrite (TiN) and titanium (Ti). In a specific embodiment, the barrier layer includes a stack of TiN and Ti layers. The liner layer is an insulating layer having a thickness in the range from 1000 angstroms to 3000 angstroms. The liner layer is used to prevent the diffusion of the metal conductive layer into the substrate. The liner layer is preferably an oxide formed by stearic tetraethoxysilane (SATEOS) or tetraethoxysilane (TEOS) and other materials.

The spacing between the through holes 202 is determined based on the size and shape of the spiral structure to be formed. In an exemplary embodiment, the through holes 202 include a first through hole 202*a*, a second through hole 202*b*, a third through hole 202*c*, and a fourth through hole 202*d*. First and second through holes 202*a* and 202*b* form one group, third and fourth through holes 202*c* and 202*d* form another group. The spacing between the first and second through holes and the spacing between the third and fourth through holes are the same while the spacing between the two groups, i.e., between second and third through holes 202*b*, 202*c* is larger than the spacing between the through holes within a group.

In an embodiment, the metal interconnect layer 208 disposed on the top surface of the substrate includes a first top metal layer 210, first top vias 212 and a second top metal layer 214.

The first top metal layer 210 includes a first plurality of mutually spaced apart portions disposed on the through holes 202 and directly connected to the through holes 202. In the exemplary embodiment, the first top metal layer 210 includes four mutually spaced apart portions 210*a*, 210*b*, 210*c*, 210*d*, each is disposed on one of first through hole 202*a*, second through hole 202*b*, third through hole 202*c*, and fourth through hole 202*d*, respectively.

The first top vias 212 are located on the first top metal layer. In the exemplary embodiment, the first top vias include four top vias 212*a*, 212*b*, 212*c*, and 212*d* disposed directly over the first top metal layer above the respective first through hole 202*a*, second through hole 202*b*, third through hole 202*c*, and fourth through hole 202*d*.

The second top metal layer 214 includes a second plurality of mutually spaced apart portions, which are connected to the top portion of the first top vias to form a top portion of the spiral structure. Portions of the second top metal layer are connected to two connecting terminals (not shown) of the spiral structure.

In the embodiment, the second top metal layer 214 includes three portions, a first portion is located above the through holes 202*a* and 202*c* and connected to the through holes 202*a* and 202*c* through the first top vias 212*a* and 212*c* and the first top metal layer to form a top portion of the spiral structure.

A second portion of the second top metal 214 is positioned above the fourth through hole 202*d* and connected to the fourth through hole 202*d* through the first top via 212*d* and the first top metal layer to form a first connecting terminal of the spiral inductor. In addition, a third portion of the second top metal layer is positioned above the first top via 212*b* and connected to the second through hole 202*b* through the second top via 212*b* and the first top metal layer to form a second connecting terminal of the spiral inductor. The first and second connecting terminals will be further described in detail below.

In a specific embodiment, the spiral structure further includes a top dielectric layer 203 disposed on the top surface of the substrate 201. The metal interconnect structure is contained (embedded) within the top dielectric layer 203.

The redistribution layer 209 is disposed on the bottom (back) surface of the substrate 201 and includes a first redistribution layer and a second redistribution layer. The first redistribution layer comprises a first bottom metal layer 220. The second redistribution layer comprises a second bottom metal layer 224, which is connected to the first bottom layer 220 through bottom vias 222.

The first bottom metal layer 220 includes a plurality of mutually spaced apart portions disposed below the through holes 202 and directly connected to the through holes 202.

In the exemplary embodiment, the first bottom metal layer includes three mutually spaced apart portions, a first portion is located below the through holes 202*b* and 202*c* and is connected to the through holes 202*b* and 202*c* to form a bottom portion of the spiral structure.

The first bottom metal layer further includes second and third portions located below the respective through holes 202*a* and 202*d*. The vertical spiral inductor further includes the bottom vias 222 disposed below corresponding second and third portions of the first bottom metal layer.

The second bottom metal layer of the redistribution layer connects the through holes 202*a* and 202*d* together through corresponding bottom vias 222 and portions of the first bottom metal layer to form the bottom portion of the spiral structure.

In a specific embodiment, the spiral structure further includes a bottom dielectric layer 205 disposed on the bottom surface of the substrate 201. The bottom portion of the spiral structure is embedded in the bottom dielectric layer 205.

According to the present invention, the chip area occupied by the vertical spiral inductor depends only on the width of the metal interconnect layer and the spacing between the most spaced apart through holes of the spiral inductor. Thus, the chip area of the inductor according to the present invention is much smaller than the lateral (horizontal) spiral inductor of the prior art.

Exemplary Embodiment 2

Figure 3:
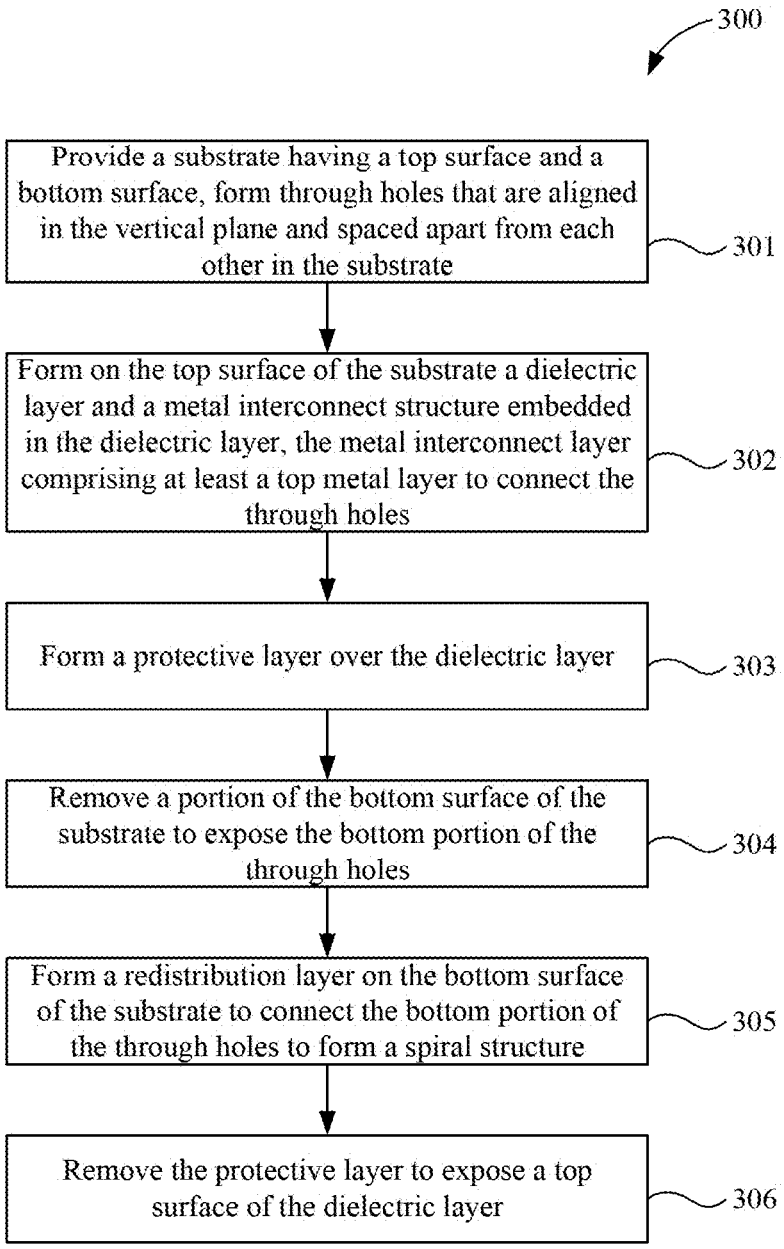
FIG. 3 is a flowchart illustrating a method for manufacturing a vertical spiral inductor according to an embodiment of the present invention.

FIG. 3 is a flowchart illustrating a method for manufacturing a spiral inductor according to an embodiment of the present invention. Although the method is shown as a sequence of numbered steps for clarity, the numbering does not necessarily impose the order of the steps. Various steps in the method may be better understood in the context of the explanations of FIGS. 2A through 2E. In accordance with the present invention, the method for fabricating a vertically spiral inductor may include:

Step 301: providing a substrate having a top surface and a bottom surface, and forming a plurality of through holes that are aligned in a vertical plane and spaced apart in the substrate. The substrate may include one or more CMOS devices comprising active or passive devices that can be manufactured using conventional process techniques. Specifically, the substrate can be a semiconductor substrate having the though holes formed therein. The semiconductor substrate may be one of silicon, silicon-on-insulator (SOI), stacked silicon-on-insulator (SSOI), stacked silicon germanium on-insulator (S-SiGeOI), silicon germanium on-insulator (SiGeOI), and others.

The through holes are formed by depositing a patterned photoresist layer on the semiconductor substrate, etching the substrate using the patterned photoresist layer as a mask to form the through holes. The patterned photoresist layer is then removed by ashing. The through holes are then filled with a conductive material. The conductive material can be deposited by a low pressure chemical vapor deposition (LPCVD) process, plasma enhanced chemical vapor deposition (PECVD) process, metal organic chemical vapor deposition (MOCVD) process, atomic layer deposition (ALD) process, or other advanced deposition processes. In a preferred embodiment, the conductive material is of a tungsten material.

In the exemplary embodiment, the plurality of through holes includes a first through hole 202*a*, a second through hole 202*b*, a third through hole 202*c*, and a fourth through hole 202*d*. First and second through holes 202*a* and 202*b* form one group, third and fourth through holes 202*c* and 202*d* form another group. The spacing between the first and second through holes and the spacing between the third and fourth through holes are the same while the spacing between the two groups, i.e., between second and third through holes 202*b*, 202*c* is larger than the spacing between the through holes within the group. FIG. 2A is a cross-sectional view showing that the through holes 202*a* through 202*d* arranged in a vertical plane according to an embodiment of the present invention.

Step 302: forming a metal interconnect structure on the top surface of the substrate. The metal interconnect structure includes at least one top metal layer to connect the top portion of the through holes. Step 302 also forming a top dielectric layer 203 on the top surface of the substrate 201. The top dielectric layer can be of an oxide, a fluorocarbon (CF), a carbon-doped silicon oxide (SiOC), a silicon carbonitride (SiCN) and the like. In a preferred embodiment, the top dielectric layer 203 is of $SiO_2$.

The metal interconnect structure can be formed by a dual damascene process. In an embodiment, an anti-reflective coating (BARC) layer is formed on the top dielectric layer, a patterned photoresist layer is then formed on the BARC layer, and the top dielectric layer is etched using the patterned photoresist layer as a mask to form a trench exposing the through holes. Thereafter, a copper plating process is performed to filled the trench to form the metal interconnect structure.

In an embodiment, the metal interconnect structure includes a first metal top layer M1 having a plurality of mutually spaced apart portions disposed on the through holes 202. The spaced apart portions are directly connected to the through holes 202. In the exemplary embodiment, the first metal top layer M1 of the metal interconnect structure include four spaced apart portion 210*a*, 210*b*, 210*c*, 210*d* each are directly connected to the top portion of the respective through holes 202*a*, 202*b*, 202*c*, and 202*d*, as shown in FIG. 2B.

Thereafter, first top vias are formed on top of the spaced apart portions of the metal interconnect structure. In the exemplary embodiment, four first top vias 212*a*, 212*b*, 212*c*, and 212*d* are formed on the four portions 210*a*, 210*b*, 210*c*, 210*d*.

Next, a second top metal layer M2 is formed on the first top vias, where the second top metal layer has a portion 214*a* connecting the first and third through holes 202*a* and 202*c* through the first top vias 212*a* and 212*c*.

The second top metal layer M2 has a portion 214*b* connecting to the second through hole 202*b* through the top second via 212*b* to form a first terminal of the spiral inductor.

The second top metal layer also has a portion 214*d* connecting to the fourth through hole 202*d* through the top fourth via 212*d* to form a second terminal of the spiral inductor.

In an embodiment, although the second top metal layer includes multiple spaced apart portions, the different portions can be formed within a single process step to simplify the fabrication process.

Step 303: forming a protective layer 204 on the metal interconnect structure, as shown in FIG. 2C. In an embodiment, the protective layer may have a higher selective etch rate than that of the top dielectric layer. In an embodiment, the protective layer may be bonded to the spiral inductor by eutectic bonding or thermal bonding to form an integral structure.

Step 304: removing a portion of the bottom surface of the substrate to expose the bottom portion of the through holes 202. In an embodiment, a portion of the bottom surface of the substrate 201 can be etched to reduce the thickness of the substrate to expose the bottom portion of the through holes 202 to form the bottom of the spiral structure, as shown in FIG. 2C. Etching the portion of the bottom surface of the substrate 201 can be dry etching or wet etching. In an embodiment, the substrate has a higher selective etch rate than that of the through holes to prevent damage to the through holes 202.

In an embodiment, the barrier layer at the bottom portion of the through holes is concurrently removed with the etching of the bottom surface of the substrate to expose the bottom portion of the conductive layer in the through holes.

Step 305: forming a redistribution layer on the bottom surface of the substrate. The redistribution layer includes at least one bottom metal layer to connect the bottom portion of the through holes 202 for forming the spiral structure.

In an embodiment, the redistribution layer includes a first redistribution layer to be the first bottom metal layer. Forming the first redistribution layer includes forming a bottom dielectric layer on the bottom of the substrate, patterned and etching the bottom dielectric layer to form one or more trenches exposing the bottom portion of the through holes 202, and filling the trenches with a metal material to form the first bottom metal layer.

In the exemplary embodiment, the first bottom metal layer (denoted as "M3" in FIG. 2D) includes three portions, a first portion 220*a* is configured to connect with first through hole 202*a*, a second portion 220*b* is configured to connect the second and third through holes 202*b* and 202*c* together, and a third portion 220*d* is configured to connect with the fourth through hole 202*d*.

Next, a second redistribution layer is formed by depositing a second dielectric layer, patterned and etching the second redistribution layer to form one or more openings exposing the first and fourth through holes 202*a* and 202*d*, and filling the openings to form the bottom vias 222*a*, 222*d*. Thereafter, a second metal layer (denoted "M4") is formed connected the first and fourth through holes 202*a* and 202*d* through the bottom vias 222*a*, 222*d* and first metal portions 220*a*, 220*d* to form the spiral structure, as shown in FIG. 2D.

Step 306: removing the protective layer 204 to expose the top dielectric layer 203, as shown in FIG. 2E. The protective layer 204 can be removed by dry etching or wet etching. The protective layer 204 can also be removed by a chemical mechanical polishing process. In a specific embodiment, the protective layer 204 may be removed by wet etching using an etchant solution with a higher selective etch rate for the protective layer than for the top dielectric layer to prevent possible damage to the metal interconnect structure.

The method may also include other steps of forming a spiral inductor and other related steps of forming other devices.

FIG. 3 is a flowchart illustrating a method 300 for manufacturing a spiral inductor according to an embodiment of the present invention. Method 300 includes:

Step 301: providing a substrate having a top surface and a bottom surface, and forming a plurality of through holes aligned in a vertical plane and spaced apart from each other;

Step 302: forming a dielectric layer on the top surface of the substrate and a metal interconnect structure embedded in the dielectric layer. The metal interconnect structure includes at least one top metal layer for connecting the top portion of the through holes;

Step 303: forming a protective layer on the metal interconnect structure;

Step 304: removing a portion of the bottom surface of the substrate to expose the bottom portion of the through holes;

Step 305: forming a redistribution layer on the bottom surface of the substrate. The redistribution layer includes at least one bottom metal layer for connecting the bottom portion of the through holes to form a spiral structure;

Step 306: removing the protective layer to expose the top surface of the dielectric layer.

Exemplary Embodiment 3

Example embodiments of the present invention also provide an electronic device that includes a vertical spiral inductor described in exemplary embodiment 1.

Specifically, the spiral inductor in the vertical plane includes through-silicon vias (alternatively referred to as through holes) that are aligned in a vertical plane and connected with each other through a top metal layer and a bottom metal layer, so that the silicon area of the spiral inductor only depends on the width of the metal interconnect layers and the distance between the two most spaced apart through-silicon vias. Comparing to the conventional lateral planar inductors, the vertical inductor of the present invention occupies significantly less silicon area, thereby reducing the dimension of the electronic device and increasing the integration of the electronic device. Furthermore, due the vertical structure of the spiral inductor, magnetic fields generated by adjacent devices have less a negative impact of performance characteristics of the inductor.

According to the present invention, the electronic device, in addition to one or more vertically disposed spiral inductors, may include passive components such as resistors, capacitors and micro-mechanical-electrical system (MEMS) sensors such as motion sensors, accelerator sensors, or a mobile phone including those MEMS sensors. The electronic device may be an intermediate electronic product comprising the vertical spiral inductor such as a printed circuit board and the like.

While the present invention is described herein with reference to illustrative embodiments, this description is not intended to be construed in a limiting sense. Rather, the purpose of the illustrative embodiments is to make the spirit of the present invention be better understood by those skilled in the art. In order not to obscure the scope of the invention, many details of well-known processes and manufacturing techniques are omitted. Various modifications of the illustrative embodiments as well as other embodiments will be apparent to those of skill in the art upon reference to the description. For example, although four through holes (through-silicon vias) are used, it is understood that the number can be more or fewer than four in other embodiments. It is therefore intended that the appended claims encompass any such modifications.

Furthermore, some of the features of the preferred embodiments of the present invention could be used to advantage without the corresponding use of other features. As such, the foregoing description should be considered as merely illustrative of the principles of the invention, and not in limitation thereof.

What is claimed is:

1. A method of fabricating a spiral inductor, the method comprising:

providing a substrate having a top surface and a bottom surface;

forming a plurality of through holes aligned in a same vertical plane and spaced apart from each other;

forming a metal interconnect structure having at least one top metal layer on the top surface of the substrate, the metal interconnect structure configured to connect to a top portion of the through holes;

forming a redistribution layer having at least a bottom layer on the bottom surface of the substrate, the redistribution layer configured to connect to a bottom portion of the through holes to form a spiral structure in the same vertical plane.

2. The method of claim 1, further comprising, after forming the metal interconnect structure, forming a protective layer on the metal interconnect structure.

3. The method of claim 2, further comprising, after forming the redistribution layer, removing the protective layer.

4. The method of claim 1, further comprising:

forming a plurality of bottom vias in the redistribution layer.

5. The method of claim 1, wherein the plurality of through holes comprises a first through hole, a second through hole, a third through hole, and a fourth through hole; the method further comprising:

forming a first top metal layer having a plurality of spaced apart portions;

forming a plurality of top vias on the first top metal layer;

forming a second top metal layer on the plurality of top vias, the second top metal layer having at least three portions, wherein a first portion connects the first through hole with the third through hole through first and second top vias.

6. The method of claim 5, further comprising:

connecting a second portion of the second top metal layer with the second through hole through a third top via to form a first connecting terminal; and connecting a third portion of the second top metal layer with the fourth through hole through a fourth top via to form a second connecting terminal.

7. The method of claim 1, wherein the plurality of through holes comprises a first through hole, a second through hole, a third through hole, and a fourth through hole; the method further comprising:

removing a portion of the bottom surface of the substrate to expose the bottom portion of the through holes;

forming a first bottom metal layer having a plurality of spaced apart portions, one of the spaced apart portion connecting the second and third through holes;

forming a plurality of bottom vias on the first bottom metal layer; and forming a second bottom metal layer on the bottom vias connecting the first and fourth through holes.

8. A method of fabricating a spiral inductor, the method comprising:

providing a substrate having a top surface and a bottom surface;

forming a first set of through holes and a second set of through holes spaced apart from each other by a first distance, the through holes in the first set of the through holes and the through holes in the second set of through holes being spaced apart from each other by a second distance that is smaller than the first distance;

forming a metal interconnect structure having at least one top metal layer on the top surface of the substrate, the metal interconnect structure configured to connect to a top portion of the through holes; and forming a redistribution layer having at least a bottom layer on the bottom surface of the substrate, the redistribution layer configured to connect to a bottom portion of the through holes to form a spiral structure in a same vertical plane.

9. The method of claim 8, wherein forming the metal interconnect structure comprises:

forming a dielectric layer on the top surface of the substrate;

forming a patterned photoresist layer on the dielectric layer;

etching the dielectric layer using the patterned photoresist layer as a mask to form a trench exposing the through holes; and filling the trench with a metal material to form the metal interconnect structure.

10. The method of claim 8, further comprising, after forming the metal interconnect structure, forming a protective layer on the metal interconnect structure.

11. The method of claim 10, further comprising, after forming the redistribution layer, removing the protective layer.

12. The method of claim 8, further comprising, after forming the metal interconnect structure and prior to forming the redistribution layer:

removing portion of the bottom surface of the substrate to expose the bottom portion of the through holes.

13. The method of claim 8, wherein forming the redistribution layer comprises:

forming a first redistribution layer having a first bottom metal layer; and forming a second redistribution layer over the first redistribution layer and having a second bottom metal layer.

14. The method of claim 8, wherein the metal interconnect layer comprises a plurality of top vias.

15. The method of claim 8, wherein the redistribution layer comprises a plurality of bottom vias.

16. The method of claim 8, wherein the at least one top metal layer comprises:

a first top metal layer including first, second, third, and fourth top portions spaced apart from each other, each of the top portions being directly connected to one of the through holes; and a second top metal layer including a first portion, a second portion, and a third portion spaced apart from each other, wherein the first portion of the second top metal layer is connected to the first and third top portions of the first top metal layer, the second portion of the second top metal layer is connected to the second top portion of the first top metal layer and a first terminal of the spiral inductor, and the third portion of the second top metal layer is connected to the fourth portion of the first top metal layer and a second terminal of the spiral inductor.

17. The method of claim 16, wherein the first terminal and the second terminal are disposed at opposite ends of the spiral inductor.

18. The method of claim 8, wherein each of the through holes comprises a liner layer on an inner surface, a barrier layer on the liner layer, and a conductive layer on the barrier layer.

19. The method of claim 18, wherein the barrier layer comprises a stack of TiN and Ti layers.

20. The method of claim 18, wherein the conductive layer comprises one of Pt, Au, Ti, and W, or a combination thereof.

* * * * *